United States Patent [19]

Schmieg

[11] 3,950,068

[45] Apr. 13, 1976

[54] ELECTRICAL QUICK DISCONNECT PLUG

[75] Inventor: Gerhard Schmieg, Germering, Germany

[73] Assignee: Siemens Aktiengesellschaft, Berlin and Munich, Germany

[22] Filed: Mar. 4, 1974

[21] Appl. No.: 447,964

[30] Foreign Application Priority Data

Mar. 9, 1973 Germany ..... 2311809

[52] U.S. Cl. ..... 339/176 M; 339/217 S

[51] Int. Cl.[2] ..... H01R 13/50

[58] Field of Search ..... 339/176 R, 176 M, 176 P, 339/217 S

[56] References Cited

UNITED STATES PATENTS

| | | | |
|---|---|---|---|
| 3,569,899 | 3/1971 | Laser | 339/176 R |
| 3,636,503 | 1/1972 | Bernutz | 339/217 S |
| 3,757,277 | 9/1973 | Yamanoue | 339/176 M |

FOREIGN PATENTS OR APPLICATIONS

| | | | |
|---|---|---|---|
| 1,276,158 | 8/1968 | Germany | 339/176 M |

*Primary Examiner*—Roy Lake
*Assistant Examiner*—Mark S. Bicks
*Attorney, Agent, or Firm*—Hill, Gross, Simpson, Van Santen, Steadman, Chiara & Simpson

[57] ABSTRACT

An electrical disconnect plug comprises an insulating plate having an enlarged plug portion at one end thereof defining a pair of slit-like apertures and metal strips lie along the opposite surfaces of said plate and are obtusely angled in the area of said slit-like aperture and have tongues bent away from the plane surfaces thereof which cooperate with shoulder portions of the plug to maintain the strips in fixed position within the plug.

2 Claims, 3 Drawing Figures

ELECTRICAL QUICK DISCONNECT PLUG

BACKGROUND OF THE INVENTION

Field of the Invention

This invention is directed to a quick disconnect plug which is designed so that the metal contact strips are mechanically maintained in fixed position on the insulating plate by frictional engagement between an obtusely angled portion of the said metal strips and the slit-like aperture in the plugs and resilient tongues which extend outwardly from the surface of the strip.

It has been found desirable to provide a means whereby an electrical quick disconnect plug can be constructed without requiring any separate parts other than the insulating plug plate and the electrically conductive metal strips and to insure that the electrically conductive metal strips will be firmly seated on the supporting plate and will not chatter.

It is desriable that the interconnection of such plugs with one another be carried out without chatter and that the contact surface be as free from play as possible and that such advantages be provided in a plug which can be readily and inexpensively mass produced.

SUMMARY OF THE INVENTION

The quick disconnect plug which is constructed in accordance with the principles of this invention comprises essentially only an insulating plate and at least two metal strips lying along opposite surfaces of the plate. Grooves are formed on one edge of the plate and the ends of the electrically conductive metal strips are hooked into those grooves and the remainder of the strips lie in substantial coplanar relation with the plate. The strips extend through slit-like apertures in the plug and have obtusely angled portions which grip the walls of the apertures. In order to lock the strips in position in the plug the strips also have out-turned lugs cooperating with shoulder portions of the plug. A simple chatter free plug is thus provided which requires no other means to affix the metal strips in the insulating plate other than the cooperative portions of the strips and plate themselves.

It is, therefore, an object of this invention to provide an electrical quick disconnect plug of simplified construction which assures that the electrically conductive metal strips will be fixed to the insulator plate free of play and maintained in fixed position without requiring other fixitive agents or elements.

Figure 1:
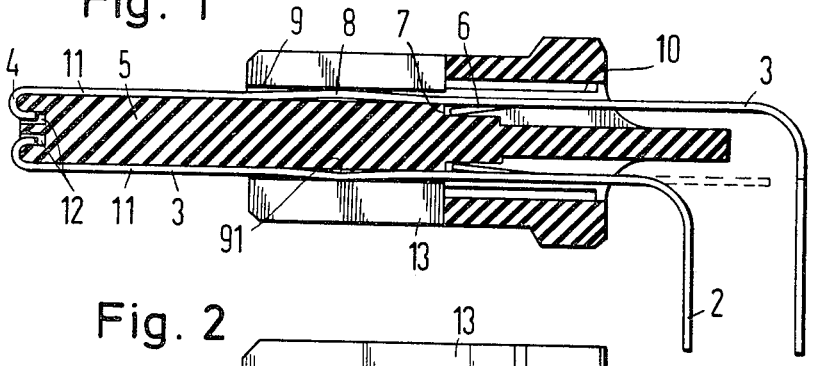
Figure 2:
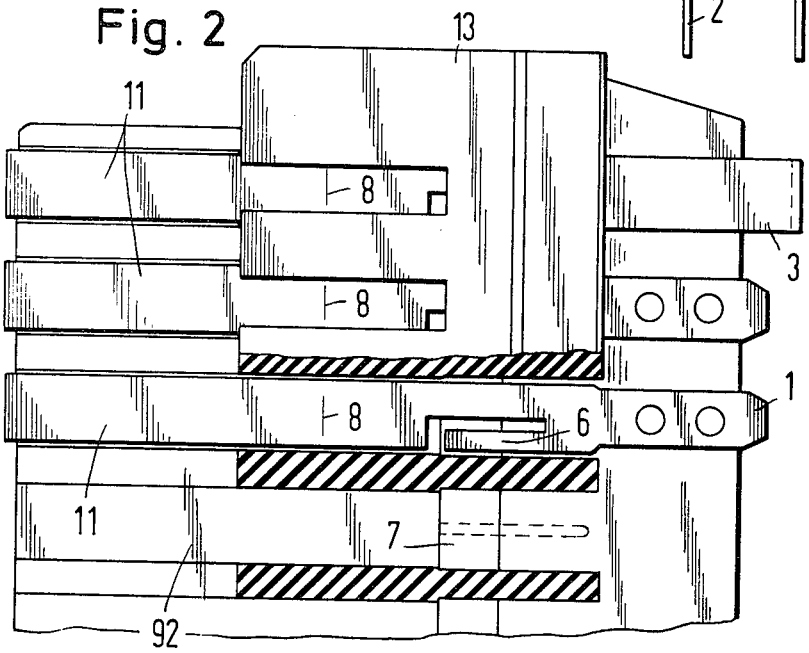
Figure 3:
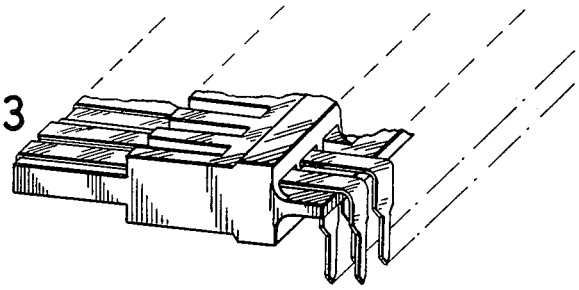

These and other objects, features and advantages of the present invention will be understood from time to time as the following specifications proceeds and with reference to the accompanying drawing wherein FIG. 1 shows a vertical sectional view through a plug constructed in accordance with the principles of this invention;

FIG. 2 is a fragmentary partially horizontal sectional view of the plug illustrated in FIG. 1; and FIG. 3 is a fragmentary perspective view of that same plug.

The drawing illustrates an electrical quick disconnect plug including an elongated plate 5 extending generally horizontally in the drawing and an enlarged plug portion 13. The left hand edge of the plate 5 has a pair of grooves 12 formed longitudinally therein which serve as seats for the hooked end portion 4 of a pair of metal strips 2 and 3. The strips 3 have their contact surfaces 11 lying in juxtaposition to the opposite surfaces of the insulating plate 5 and extending through slit-like apertures 9 formed in the enlarged plug portion 13. The portions of the metal strips 2, 3 which extend through the slit-like apertures 9 are obtusely angled and have vertices disposed in contact with the surfaces of the plug defining the aperture 9 so as to maintain the contact surface 11 of the strips 2, 3 in coplanar relation with the insulating plate 5.

Shoulders 7 are formed on the plug immediately adjacent the right hand most of the slit-like apertures 9 and the metal strips 2, 3 each have out turned tongues or lugs 6 which are resilient and which cooperate with the shoulders 7 to prevent the strips from being moved out of the fixed position in the plug.

During construction of the plug, the metal strips are simply forced through the slit-like apertures from left to right until the lugs 6 snap over the shoulders 7 and the hooked ends 4 move into grooves 12. After that action has taken place, the vertices of the obtuse angled portions of the strips will have firmly seated the strips in their fixed position in order to prevent chatter and the strips will be locked in position and the right hand most ends of the strips can be bent right angularly as desired as shown in FIGS. 1 and 3. It will further be observed that the right hand portion of the plate extends beyond the point of right angularly bending of the lower metal strip 2 so as to insure electrical separation of the strips from one another in the event they are bent as shown in FIGS. 1 and 3.

I claim as my invention:

1. A quick disconnect electrical connector plug comprising an insulating plate having grooves formed in one end face thereof, a pair of metal strips having ends carried in said grooves and hooked over the end of said plate and lying along opposite surfaces thereof, said connector plug having an enlarged head formed integrally with said plate at the other end thereof and having elongated slit-like apertures formed in said enlarged head and in coplanar relation with said plate, each of said apertures having a wall parallel to and opposite said plate, shoulders formed on said connector plug adjacent the ends of said apertures opposite said one end of said plate, each of said metal strips extending through one of said slit-like apertures and being formed with a single obtusely angled portion fitted within said one of said apertures, said obtusely angled portion consisting of a single bend wherein the apex thereof contacts said parallel wall of said one of said apertures, within the confines of said said one of said apertures and said metal strips having tongues extending outwardly from the surface of said strips intermediate the ends thereof and overlying said shoulders whereby to fix said strips in position in said plug.

2. A connector constructed in accordance with claim 1 wherein the ends of said strips extending beyond said shoulder are bent at right angles and wherein a portion of said plate extends above the right angular bend in one strip end so as to insure electrical insulation of the respective strip ends.

* * * * *